US012702161B2

(12) United States Patent
Moloney

(10) Patent No.: US 12,702,161 B2
(45) Date of Patent: Aug. 11, 2026

(54) AEROSOL PROVISION SYSTEM

(71) Applicant: NICOVENTURES TRADING LIMITED, London (GB)

(72) Inventor: Patrick Moloney, London (GB)

(73) Assignee: NICOVENTURES TRADING LIMITED, London (GB)

( * ) Notice: Subject to any disclaimer, the term of this patent is extended or adjusted under 35 U.S.C. 154(b) by 1346 days.

(21) Appl. No.: 17/600,290

(22) PCT Filed: Mar. 18, 2020

(86) PCT No.: PCT/GB2020/050708
§ 371 (c)(1),
(2) Date: Sep. 30, 2021

(87) PCT Pub. No.: WO2020/201706
PCT Pub. Date: Oct. 8, 2020

(65) Prior Publication Data

US 2022/0175028 A1 Jun. 9, 2022

(30) Foreign Application Priority Data

Apr. 5, 2019 (GB) ..... 1904847

(51) Int. Cl.
*A24F 40/30* (2020.01)
*A24F 40/20* (2020.01)
(Continued)

(52) U.S. Cl.
CPC ..... *A24F 40/30* (2020.01); *A24F 40/20* (2020.01); *A24F 40/42* (2020.01); *A24F 40/46* (2020.01); *A24F 40/465* (2020.01); *A24F 40/57* (2020.01)

(58) Field of Classification Search
CPC ..... A24F 40/30; A24F 40/20; A24F 40/42; A24F 40/46; A24F 40/465; A24F 40/57; A24F 40/40; A24F 40/50; H02M 1/0003
See application file for complete search history.

(56) References Cited

U.S. PATENT DOCUMENTS 5,179,966 A 1/1993 Losee et al.
5,322,075 A 6/1994 Deevi et al.
(Continued)

FOREIGN PATENT DOCUMENTS

CN 1102964 A 5/1995
CN 105636466 A 6/2016
(Continued)

OTHER PUBLICATIONS

"Decision of Refusal received for Japanese Patent Application No. 2021-554588, mailed on Jul. 11, 2023", 7 pages (3 pages of English Translation and 4 pages of Official Copy).
(Continued)

*Primary Examiner* — Travis S Chambers
(74) *Attorney, Agent, or Firm* — MERCHANT & GOULD P.C.

(57) ABSTRACT

An aerosol provision system can include an aerosol generating medium, a source of energy for heating configured to cause heating of the aerosol generating medium in a heating zone, a movement mechanism arranged to move the aerosol generating medium, an aerosol outlet through which an aerosol can flow to be inhaled by a user, and a flow path arranged between the heating zone and the aerosol outlet such that aerosol formed from heated aerosol generating medium flows along the flow path. The aerosol generating medium can be translatable past the source of energy for heating, into the heating zone, such that respective portions of aerosol generating medium are individually presented to the source of energy for heating to form an aerosol and
(Continued)

wherein the aerosol generating medium can be arranged to move along a line that is at an angle to the flow path of generated aerosol.

18 Claims, 6 Drawing Sheets

(51) Int. Cl.

| | |
|---|---|
| ***A24F 40/42*** | (2020.01) |
| ***A24F 40/46*** | (2020.01) |
| ***A24F 40/465*** | (2020.01) |
| ***A24F 40/57*** | (2020.01) |

(56) References Cited

U.S. PATENT DOCUMENTS

| | | | | |
|---|---|---|---|---|
| 5,479,948 | A * | 1/1996 | Counts | A24F 40/42 131/194 |
| 5,649,554 | A * | 7/1997 | Sprinkel | A24F 40/465 131/194 |
| 5,996,589 | A | 12/1999 | St | |
| 8,881,737 | B2 | 11/2014 | Collett et al. | |
| 9,220,294 | B2 | 12/2015 | Mccullough | |
| 9,498,002 | B1 | 11/2016 | Kristian | |
| 9,775,379 | B2 * | 10/2017 | Davidson | A61M 15/0051 |
| 9,888,723 | B2 | 2/2018 | Cameron et al. | |
| 10,028,533 | B2 | 7/2018 | Fursa et al. | |
| 10,661,035 | B2 | 5/2020 | Freeman et al. | |
| 10,757,973 | B2 | 9/2020 | Alarcon et al. | |
| 2002/0078951 | A1 | 6/2002 | Nichols et al. | |
| 2005/0126562 | A1 | 6/2005 | Rabinowitz | |
| 2005/0258182 | A1 * | 11/2005 | Anderson | G06M 1/246 221/7 |
| 2006/0102175 | A1 | 5/2006 | Nelson | |
| 2006/0102715 | A1 | 5/2006 | Matsumoto | |
| 2013/0255702 | A1 | 10/2013 | Griffith et al. | |
| 2013/0276799 | A1 | 10/2013 | Davidson et al. | |
| 2016/0271347 | A1 | 9/2016 | Raichman | |
| 2017/0095624 | A1 | 4/2017 | Davidson et al. | |
| 2017/0245550 | A1 | 8/2017 | Kristian | |
| 2018/0154103 | A1 | 6/2018 | Davis | |
| 2019/0208823 | A1 * | 7/2019 | Raichman | A61P 25/36 |
| 2022/0175040 | A1 * | 6/2022 | Spencer | A61M 15/0048 |
| 2022/0330609 | A1 * | 10/2022 | Xie | A24F 40/60 |

FOREIGN PATENT DOCUMENTS

| | | | |
|---|---|---|---|
| CN | 106455704 | A | 2/2017 |
| EP | 0 640 297 | A1 | 3/1995 |
| EP | 2706877 | B1 | 9/2015 |
| JP | H07147965 | A | 6/1995 |
| JP | 2017519493 | A | 7/2017 |
| JP | 2017192393 | A | 10/2017 |
| JP | 2018504127 | A | 2/2018 |
| KR | 100312101 | B1 | 12/2001 |
| KR | 20180070439 | A | 6/2018 |
| RU | 2135054 | C1 | 8/1999 |
| UA | 41898 | C2 | 10/2001 |
| WO | 0028844 | A1 | 5/2000 |
| WO | WO 2012/085919 | A2 | 6/2012 |
| WO | 2014147114 | A1 | 9/2014 |
| WO | 2015042412 | A1 | 3/2015 |
| WO | 2015046420 | A1 | 4/2015 |
| WO | 2015176898 | A1 | 11/2015 |
| WO | 2017203515 | A1 | 11/2017 |
| WO | 2018146071 | A1 | 8/2018 |
| WO | 2018215781 | A1 | 11/2018 |
| WO | 2019016740 | A1 | 1/2019 |
| WO | 2019030360 | A1 | 2/2019 |

OTHER PUBLICATIONS

"Office Action received for Chinese Application No. 202080033120.5, mailed on Jun. 1, 2024", 16 pages (7 pages of English Translation and 9 pages of Official Copy).

"Office Action received for Korean Patent Application No. 10-2021-7028904, mailed on Aug. 30, 2023", 8 pages (4 pages of English Translation and 4 pages of Official Copy).

"Office Action received for Korean Patent Application No. 10-2021-7031551, mailed on Sep. 25, 2023", 11 pages (6 pages of English Translation and 5 pages of Official copy).

"Office Action received for Korean Patent Application No. 10-2021-7031556, mailed on Sep. 25, 2023", 11 pages (6 pages of English Translation and 5 pages of Official copy).

"Reasons for Refusal received for Japanese Patent Application No. 2023-115278, mailed on Jul. 30, 2024", 3 pages (English Translation only).

Examination Report received for Australian Patent Application No. 2020251739, mailed on Aug. 5, 2022, 3 pages.

International Preliminary Report on Patentability received for International Patent Application No. PCT/EP2020/056263, mailed on Sep. 23, 2021, 9 pages.

International Preliminary Report on Patentability received for International Patent Application No. PCT/GB2020/050708, mailed on Oct. 14, 2021, 10 pages.

International Preliminary Report on Patentability received for International Patent Application No. PCT/GB2020/050709, mailed on Oct. 14, 2021, 18 pages.

International Search Report and Written Opinion received for International Patent Application No. PCT/EP2020/056263, mailed on Jun. 25, 2020, 13 pages.

International Search Report and Written Opinion received for International Patent Application No. PCT/GB2020/050709, mailed on Aug. 17, 2020, 25 pages.

Notice of Reasons for Refusal received for Japanese Patent Application No. 2021-554588, mailed on Jan. 4, 2023, 8 pages (4 pages of English Translation and 4 pages of Official Copy).

Office Action received for Russian Patent Application No. 2021128793, mailed on Jul. 29, 2022, 8 pages (English Translation Only).

Office Action received for Russian Patent Application No. 2021128824, mailed on Mar. 18, 2022, 18 pages (7 pages of English Translation and 11 pages of Official Copy).

Invitation to Pay Additional Fees received for PCT Patent Application No. PCT/GB2020/050708, mailed on Jun. 17, 2020, 9 pages.

Invitation to Pay Additional Fees received for PCT Patent Application No. PCT/GB2020/050709, mailed on Jun. 25, 2020,18 pages.

PCT International Search Report and Written Opinion of the ISA for PCT/GB2020/050708, mailed Aug. 12, 2020, 19 pages.

* cited by examiner

AEROSOL PROVISION SYSTEM

PRIORITY CLAIM

The present application is a National Phase entry of PCT Application No. PCT/GB2020/050708, filed Mar. 18, 2020, which claims priority from GB Application No. 1904847.9, filed Apr. 5, 2019, which is hereby fully incorporated herein by reference.

TECHNICAL FIELD

The present disclosure relates to an aerosol provision system, a method of generating an aerosol in an aerosol provision device, a consumable for use in an aerosol provision device and an aerosol provision device.

BACKGROUND

Aerosol provision devices are known. Common devices use heaters to create an aerosol from a suitable medium which is then inhaled by a user. Often suitable media require significant levels of heating prior to generating an aerosol for inhalation. Similarly, current devices offer users a large variety in the media from which inhalable aerosol can be generated. Current devices often require a change in the device, such as the loading of the media, to enable a change in the aerosol generating medium active within the device.

It is desirable for aerosol provision devices to rapidly deliver an aerosolized payload to a user. Therefore there is a requirement to avoid long warm up times prior to a user receiving an aerosolized payload.

The present disclosure is directed toward solving some of the above problems.

SUMMARY

Aspects of the disclosure are defined herein.

In accordance with some embodiments described herein, there is provided an aerosol provision system comprising: an aerosol generating medium; a source of energy for heating, wherein the source of energy for heating is configured to cause heating of the aerosol generating medium in a heating zone; a movement mechanism arranged to move the aerosol generating medium; an aerosol outlet through which an aerosol can flow to be inhaled by a user; and a flow path arranged between the heating zone and the aerosol outlet such that aerosol formed from heated aerosol generating medium flows along the flow path, wherein the aerosol generating medium is translatable past the source of energy for heating, into the heating zone, such that respective portions of aerosol generating medium are individually presented to the source of energy for heating to form an aerosol; and wherein the aerosol generating medium is arranged to move along a line that is at an angle to the flow path of generated aerosol.

In accordance with some embodiments described herein, there is provided a method of generating an aerosol in an aerosol provision system, the method comprising: providing an aerosol generating medium; providing a source of energy for heating; providing a movement mechanism; providing an aerosol outlet through which an aerosol can flow to be inhaled by a user; individually moving the aerosol generating medium by the movement mechanism past the source of energy for heating into a heating zone by translation, heating a first portion of aerosol generating medium presented to the source of energy for heating in the heating zone to form an aerosol; wherein the aerosol generating medium is arranged along a line that is at an angle to a flow path of generated aerosol, the flow path arranged between the heating zone and the aerosol outlet.

In accordance with some embodiments described herein, there is provided a consumable for use in an aerosol provision device comprising: a strip comprising a plurality of portions of aerosol generating medium along its length, wherein the plurality of portions are individually distinct from one another.

In accordance with some embodiments described herein, there is provided an aerosol provision device configured to receive aerosol generating medium, comprising: a source of energy for heating, wherein the source of energy for heating is configured to cause, in use, heating of the aerosol generating medium in a heating zone; a movement mechanism arranged to, in use, move the aerosol generating medium; an aerosol outlet through which, in use, an aerosol can flow to be inhaled by a user; and a flow path arranged between the heating zone and the aerosol outlet such that, in use, aerosol formed from heated aerosol generating medium flows along the flow path, wherein the aerosol generating medium is translatable past the source of energy for heating, into the heating zone, such that respective portions of aerosol generating medium are individually presented to the source of energy for heating to form an aerosol, and wherein the movement mechanism is arranged, in use, to move the aerosol generating medium along a line that is at an angle to the flow path of generated aerosol.

In accordance with some embodiments described herein, there is provided aerosol provision means comprising: aerosol generating means; and heating means, wherein the heating means is configured to heat the aerosol generating means to form an aerosol; movement provision means arranged to move the aerosol generating means, a heating zone into which the aerosol generating means are moved by the movement provision means to form an aerosol; an aerosol outlet means through which an aerosol can flow to be inhaled by a user; a flow path arranged between the heating zone and the aerosol outlet means such that aerosol formed from heated aerosol generating means flows along the flow path wherein the aerosol generating means are linearly translatable past the heating means, into the heating zone, such that respective portions of aerosol generating means are individually presented to the heating means to form an aerosol; and wherein the aerosol generating means are arranged to move along a line that is at an angle to the flow path of generated aerosol.

DESCRIPTION OF DRAWINGS

The present teachings will now be described by way of example only with reference to the following figures in which like parts are depicted by like reference numerals.

Figure 1:
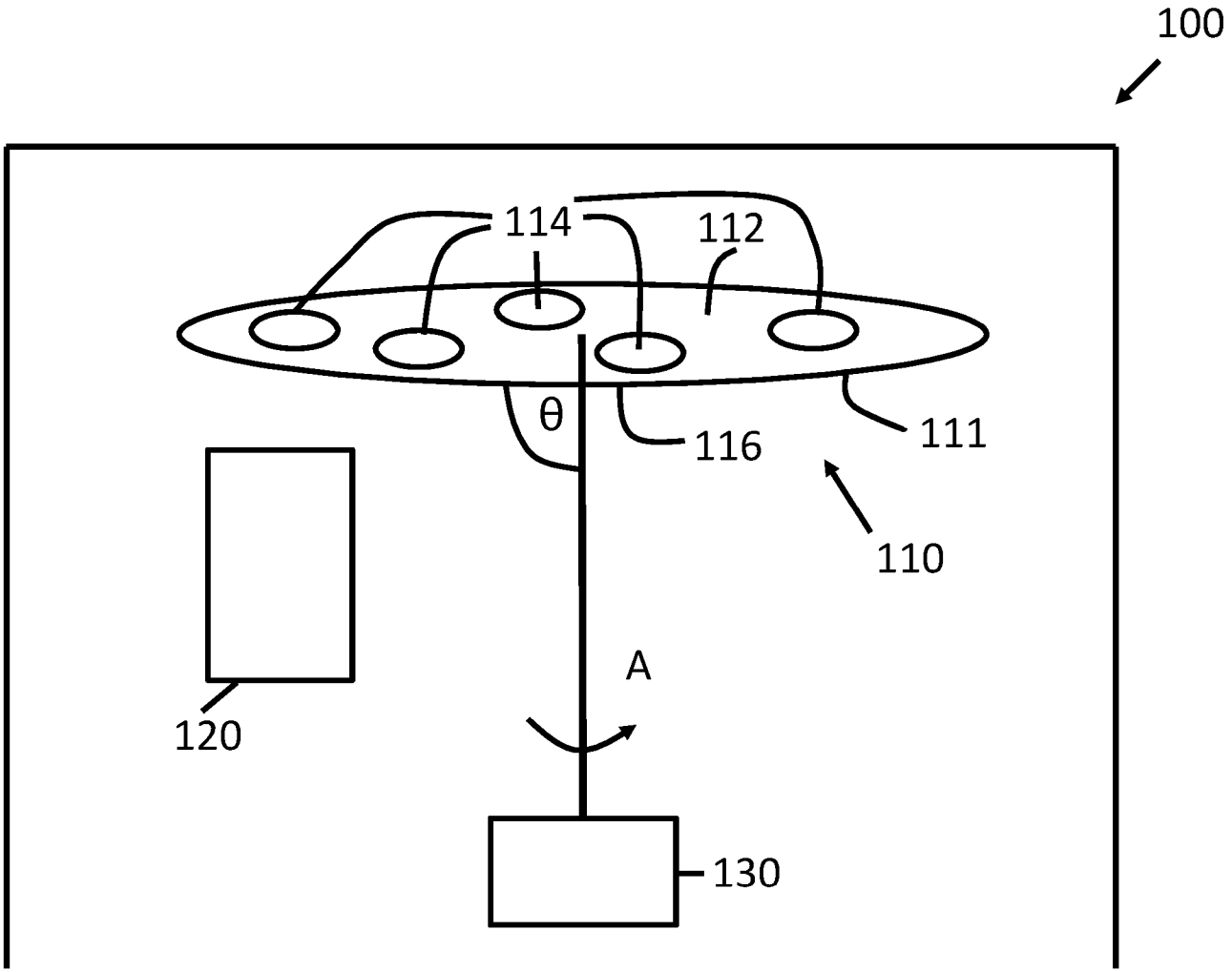
FIG. 1 is a schematic sectional view of a portion of an aerosol provision device according to an example.

While the disclosure is susceptible to various modifications and alternative forms, specific embodiments are shown by way of example in the drawings and are herein described in detail. It should be understood, however, that the drawings and detailed description of the specific embodiments are not intended to limit the disclosure to the particular forms disclosed. On the contrary, the disclosure covers all modifications, equivalents and alternatives falling within the scope of the present disclosure.

DETAILED DESCRIPTION

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to aerosol provision systems, which may also be referred to as aerosol provision systems, such as e-cigarettes. Throughout the following description the term "e-cigarette" or "electronic cigarette" may sometimes be used, but it will be appreciated this term may be used interchangeably with aerosol provision system/device and electronic aerosol provision system/device. Furthermore, and as is common in the technical field, the terms "aerosol" and "vapor", and related terms such as "vaporize", "volatilize" and "aerosolize", may generally be used interchangeably.

FIG. 1 illustrates a schematic view of a portion of an aerosol provision device 100. The device 100 is designed to simulate a cigarette and therefore may have a substantially cylindrical shape and may be approximately the same size as a cigarette. The device 100 has a substrate 110, which comprises aerosol generating medium, within the device 100. The combination of the device 100 and the substrate 110 form an aerosol provision system. The substrate 110 has a first surface 112 which includes aerosol generating medium. In a described implementation, the substrate 110 may include a carrier layer 111 (sometimes referred to herein as a carrier or a substrate supporting layer) which has a first surface on which the aerosol generating medium is disposed. In this implementation, a combination of the surface of the carrier layer 111 and of the aerosol generating material forms the first surface 112 of the substrate 110.

The aerosol generating medium may be in the form of portions or doses 114 of aerosol generating medium. The terms portion and dose may be used interchangeably throughout this description. It is intended to mean a part of the whole aerosol generating medium. The substrate 110 has a second surface 116 which is opposite the first surface 112. In a described implementation, the second surface 116 is formed by the carrier layer 111. That is, the carrier layer 111 has a first surface and a second surface which faces the first surface, where aerosol generating material is disposed on the first surface of the carrier layer 111.

The device 100 has a source of energy for heating 120 arranged to face the second surface 116 of the substrate 110. The source of energy for heating 120 may be a heater, the two terms will be used interchangeably throughout. The source of energy for heating 120 is an element of the aerosol provision device 100 which transfers energy from a power source, such as a battery (not shown), to the aerosol generating medium 114 to generate aerosol from the aerosol generating medium 120. In the example described below, the source of energy for heating 120 is a heater 120, e.g., a resistive heater 120, that supplies energy (in the form of heat) to the aerosol generating medium to generate aerosol from the aerosol generating medium. It should be appreciated that different heaters of heating system components may be implemented in accordance with the present disclosure.

The device 100 has a movement mechanism 130 arranged to move doses 114 of aerosol generating medium. The doses 114 of aerosol generating medium are rotationally movable relative to the heater 120 such that portions of the aerosol generating medium are individually presented to the heater 120. The device 100 is arranged such that at least one dose 114 of the aerosol generating medium is rotated around an axis A at an angle θ to the first surface 112. The substrate 110 in this implementation may be substantially flat. The carrier layer 111 of substrate 110 in this implementation may be formed of partially or entirely of paper or card.

The substrate 110 in FIG. 1 has a number (5) of doses (or portions) 114 of aerosol generating medium. In other examples, the substrate 110 may have more or less doses 114 of aerosol generating medium. In some examples, the substrate 110 may have the doses 114 of aerosol generating medium arranged in discrete doses as shown in FIG. 1. In other examples, the doses 114 may be in the form of a disc, which may be continuous or discontinuous, disposed on the first surface 112 of the substrate 110. In still other examples, the doses 114 may be in the form of an annulus, a ring or any other shape. The substrate 110 may or may not have a rotationally symmetrical distribution of doses 114 at the first surface 112 about the axis A. A symmetrical distribution of doses 114 would enable equivalently positioned doses (within the rotationally symmetrical distribution) to receive an equivalent heating profile from the heater 120 upon rotation about the axis A, if desired. The substrate 110 or the carrier layer 111 of the substrate 110 may contain nicotine, tobacco, or tobacco derivative or the like. The substrate 110 (or carrier layer 111) may be formed exclusively of such materials, or be made of more than one such material. The substrate 110 (or carrier layer 111) may have a layered structure from a plurality of materials. In one example, the substrate 110 (or carrier layer 111) may have a layer of thermally conductive material, inductive material, permeable material or impermeable material.

The device 100 may have in an example substantially the same distance to a mouthpiece and to the source of energy for heating 120 for providing a more consistent user experience. In an example the aerosol generating medium is disposed on the substrate 110 at a distance from the source of energy for heating 120 within the range of 0.010 mm, 0.015 mm, 0.017 mm, 0.020 mm. 0.023 mm, 0.025 mm, 0.05 mm, 0.075 mm, 0.1 mm, to about 4 mm, 3.5 mm, 3 mm, 2.5 mm, 2.0 mm, 1.5 mm, 1.0 mm, 0.5 mm or 0.3 mm. In some cases, there may be a minimum spacing between the source of energy for heating 120 and aerosol generating medium on the substrate 110 of at least about 10 μm, 15 μm, 17 μm, 20 μm, 23 μm, 25 μm, 50 μm, 75 μm or 0.1 mm.

The device 100 may have a plurality of chambers or regions that may or may not be separate from one another. The device 100 may have a power chamber (not shown) comprising energy stores for supplying power to the heater 120 and/or the movement mechanism 130. The heater 120 may be an electrically resistive heater 120. The heater 120 may be a chemically activated heater which may or may not operate via exothermic reactions or the like. The heater 120 provides thermal energy, heat, to the surrounding environment of the heater 120. At least some portion of the substrate 110 is within the area of effect of the heater 120. The area of effect of the heater 120 is the area within which the heater 120 may provide heat to an item. The source of energy for heating 120 may be part of an inductive heating system, wherein the source of energy for heating 120 is the source of energy for inductive heating and the substrate 110 may be or may contain a susceptor or the like. The susceptor may for example be a sheet of aluminium foil or the like. The susceptor may be part of the carrier layer 111.

The arrangement of FIG. 1 may have a slight increase in the complexity of the movement mechanism 130 to provide movement to the substrate 110 however there are benefits to be had by virtue of there only being one heater required to heat a plurality of portions of aerosol generating medium. The heater 120 in the arrangement of FIG. 1 requires only one control mechanism rather than a plurality of heaters requiring a plurality of control mechanisms. As such, this arrangement can reduce the cost and control complexity in relation to the operation and control of the heater 120.

The shape of the device 100 may be cigarette-shape (longer in one dimension than the other two) or may be other shapes. In an example, the device 100 may have a shape that is longer in two dimensions than the other one, for example like a compact-disc player or the like. Alternatively, the shape may be any shape that can suitably house the substrate 110, source of energy for heating 120 and the movement mechanism 130.

Figure 2:
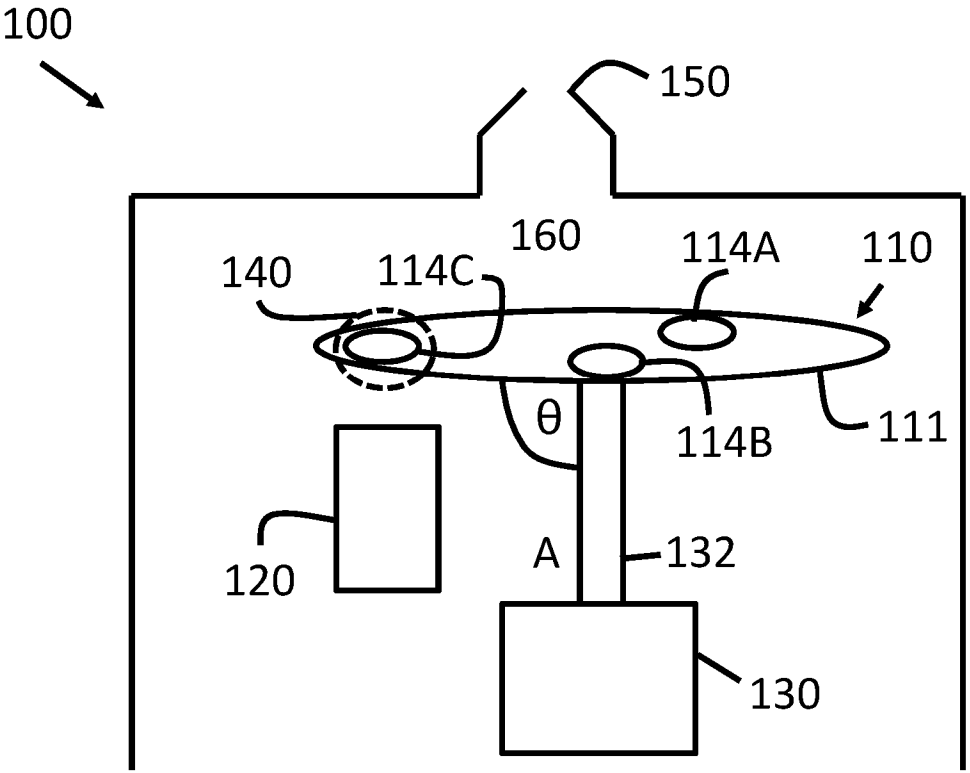
FIG. 2 is a schematic sectional view of a portion of an aerosol provision device according to an example.

FIG. 2 illustrates a sectional view of a portion of an aerosol provision device 100. FIG. 2 shows an arrangement similar to that shown in FIG. 1, with additional features including specific, individualised doses 114A, 114B, 114C of aerosol generating medium. The heater 120 has a specific region of influence relevant to the substrate 110 referred to as the heating zone 140. The heating zone 140, as shown in FIG. 1, may be located directly above the heater 120. The heating zone 140 is a region into which doses 114 of aerosol generating medium are moved by the movement mechanism 130 to form an aerosol. This movement of the doses 114 into the heating zone 140 may occur prior to heating of a dose 114 of aerosol generating medium by the heater 120. In the example shown in FIG. 2, a dose 114C of aerosol generating medium has been moved into the heating region 140. The heater 120 may heat the dose 114C in the heating region 140 to produce an aerosol. Conversely, the doses 114A, 114B not located in the heating zone 140 are located far enough away from the heating zone 140 so as to not be heated by the heater 120.

In one example of the device 100, during use the heater 120 is activated after the dose 114C has been moved into the heating region 140. This arrangement has the advantage that energy is conserved during movement phases of the substrate 110. This leads to a longer operational life of the device 100, via length of life of a power source (not shown) to the heater 120 and via length of life of the heater 120 itself.

In another example, the heater 120 may be activated prior to the dose 114C being moved into the heating region 140. This arrangement has the advantage that a warm up period is not required for the heater 120 to reach a temperature suitable for inducing aerosolization of an aerosol generating medium once the dose 114C arrives in the heating region 140. As such, the delivery of aerosol to a user inhaling on the device 100 occurs more quickly and therefore improves the user experience of the device 100.

Referring still to FIG. 2, the device 100 has a movement mechanism 130 for enabling movement of the doses 114. The movement mechanism 130 in the example shown in FIG. 2 is connected to substrate 110 by connecting element 132. The movement mechanism 130 may be a rotating element around which the substrate 110 can rotate, such as a ball bearing. In an example, the substrate 110 is positioned on the bearing 130 and can be rotated by a user or a rotating system (e.g. motor and shaft) contained within the device 100. The movement mechanism 130 may be arranged substantially centrally in the substrate 110 as shown schematically in FIG. 2, or alternatively arranged in a different relative position to the substrate 110. Centrally locating the movement mechanism 130 provides the benefit of a clear central axis A (see FIG. 1) through the center of the substrate 110 around which the substrate 110 may rotate as a result of the movement mechanism 130. Location of the movement mechanism 130 with respect to the substrate 110 may alternatively or additionally be determined in part by a desire to balance the substrate 110 on the portion of the movement mechanism 130 connected to the substrate 110. This arrangement, which may omit the connecting element 132, has the benefit of not requiring additional structures to balance the substrate 110 within the device 100, such as struts or guides.

Alternatively, additional structures may be used to allow the movement mechanism 130 to be located in any position relative to the substrate 110. Any such arrangement wherein the axis A (around which the substrate 110 may rotate) is off center to the central axis of the substrate 110 is possible, but may require intelligent arrangement of the doses 114 of aerosol generating medium on the substrate 110 alongside positioning of the heater 120. The additional structures may project from the sides of the housing of the device 100 and assist in fixing the substrate 110 in place, while allowing motion of the substrate 110.

The movement mechanism 130 and connecting element 132 may take the form of a motor and rotatable shaft, sprocketing and/or keying mechanism arranged to connect with the substrate 110. The force to move the movement mechanism 130 could be supplied by a user, for example by manually moving the substrate 110. This manual movement may be by rotating the substrate 110 or pulling the substrate 110 or the like. The movement provided by the movement mechanism 130 is not restricted to rotational movement. Linear movement and oscillatory movement, among others, may also be provided. Arrangements to provide such movements are well known. The movement mechanism 130 may provide a rotational speed to the substrate 110 which can be variable or consistent. A consistent movement provides the user with a substantially consistent level of aerosol production, as the substrate 110 consistently turns and so provides fresh aerosol generating medium to the source of energy for heating 120. Alternatively, the movement mechanism 130 may provide variable rotational speed to the substrate 110. In this example, the device 100 can provide greater or lesser amounts of aerosol as desired by the user by using a greater or lesser rotational speed. Use of varying rotational speeds may be used in conjunction with a variable heating profile from the source of energy for heating 120. The movement mechanism 130 may also provide indexed movement, such that the substrate 110 moves in a discretized manner. The amount of movement provided to the substrate 110 may be consistent or variable.

FIG. 2 also shows an aerosol outlet 150. The aerosol outlet 150 provides an outlet through which an aerosol can flow to be inhaled by a user. The outlet 150 allows for aerosol generated within the device 100 to exit the device 100. In this way, a user inhaling on the aerosol outlet 150 may inhale an aerosol generated from the heating of doses 114A, 114B, 114C of aerosol generating medium. The outlet 150 may be in the form of a mouthpiece or the like that is comfortable for a user to inhale on. In the example shown in FIG. 2, the substrate 110 is substantially planar and has a normal axis which is substantially parallel with the main axis through the outlet 150 of the device 100.

Arranged substantially between the heater 120, the heating zone 140 and the outlet 150, as shown in FIG. 2, the device 100 has a flow path 160. The flow path 160 is a route along which aerosol generated in the device 100, formed from the heated doses 114, flows to exit the device 100. The flow path 160 is relatively short so that the area on the inside of the device 100 on which the aerosol may condense is reduced. This improves the overall cleanliness of the functioning of the device 100, resulting in a reduction in the frequency with which the device 100 must be cleaned. Furthermore, as the aerosol passes over fewer components along the relatively short flow path out of the device 100, fewer components may be affected by aerosol condensing on them and therefore the components need to be replaced less frequently. This reduces the cost of maintenance of the device 100 and increases the lifetime of the overall device 100.

In an example, the heater 120 is movable. The heater 120 may be moved by the movement mechanism 130. The heater 120 may be moved by a separate movement mechanism to the movement mechanism 130. In the example of a device 100 shown in FIG. 3, the heater 120 is moved so as to improve the thermal delivery from the heater 120 to the doses 114. The heater 120 may be moved towards the first surface 112 as a specific dose 114A is moved into the heating zone 140. This reduces the air jacket between the heater 120 and the doses 114 which would otherwise absorb heat energy from the heater 120 and therefore reduce the heat energy provided to the specific dose 114A. Instead, by reducing the air jacket, the heater 120 delivers heat energy more efficiently to the specific dose 114A in the heating zone 140.

In an example, the heater 120 is moved into contact with the specific dose (or portion of a dose) moved into the heating zone 140 to maximize heat transmission between the heater 120 and the specific dose. As mentioned above, after one specific dose is heated, the doses are moved so that a fresh dose is moved into the heating zone 140. Prior to moving the doses 114, so as to move a new specific dose into the heating zone 140, the heater 120 is moved away from the doses to prevent high levels of friction during the movement of the doses 114 by the movement mechanism 130. Heater connecting element 134, in the example shown in FIG. 3, links the movement mechanism 130 to the heater 120 to enable the motion of the heater 120. In an example the motion of the heater 120 may be linear motion. In an alternative arrangement, the movement mechanism 130 may enable linear motion of the substrate 110 along an axis between the heater 120 and the first surface 112 or second surface 116. This arrangement reduces the likelihood of the heater catching or tearing on the substrate 110 or the doses 114. The heater connecting element 134 may be in the form of a motor and vertically extending shaft or a biased member which can be controlled to expand and contract. In a particular example, the movement provided to the heater 120 and to the substrate 110 may be offset such that one moves while the other is stationary (i.e. has zero velocity). In this example, the substrate 110 may be rotated to move a fresh portion of aerosol generating medium into the heating location 140, the source of energy for heating 120 may then be moved towards the substrate 110 then, after the portion is depleted, the source of energy for heating 120 may be moved away from the substrate 110, prior to a further rotation of the substrate 110. This may prevent catching of the source of energy for heating 120 on the substrate 110 which could lead to tearing of the substrate 110.

In an example, the source of energy for heating 120 and/or the aerosol generating medium are moved in the linear direction, prior to the aerosol generating medium being rotationally moved relative to the source of energy for heating 120.

Figure 3:
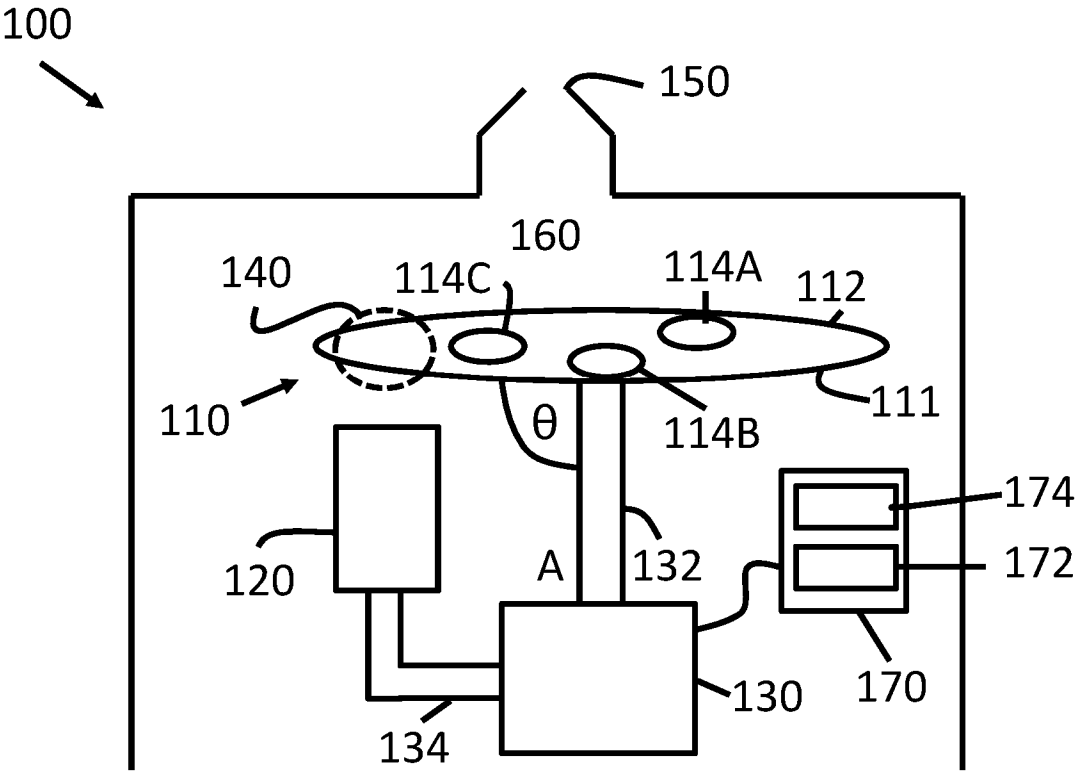
FIG. 3 is a schematic sectional view of a portion of an aerosol provision device according to an example.

In the examples shown in FIGS. 1 to 3, the angle θ between the axis A and the first surface 112 around which the aerosol generating medium is rotated is substantially perpendicular. In other examples, the angle θ may be any angle. For example, the angle θ may be at least 5°, at least 10°, at least 15°, at least 20°, at least 25°, at least 30°, at least 35°, at least 40°, at least 45°, at least 50°, at least 55°, at least 60°, at least 65°, at least 70°, at least 75°, at least 80°, at least 85°.

The device 100 may have a controller 172 for monitoring and/or controlling movement provided by the movement mechanism 130. The controller 172 may control the movement of the doses 114 such that doses 114 are controllably moved into the heating zone 140. The controller 172 may also be able to inform the user on the number of remaining viable doses 114 in the device 100.

In an example, the device 100 may have a motion monitoring system 170 which comprises the controller 172. The monitoring system 170 may monitor the motion within the device 100. The monitoring system 170 may also comprise a detector 174 for detecting movement information. The monitoring system 170 monitors the motion of the substrate 110 and/or the doses 114 of aerosol generating medium to record movement that has occurred and thereby avoid moving the same specific dose into the heating zone 140 twice. This avoids undesired aerosols being formed from reheating of a "spent" dose. The detector 174 may relay to the user information relating to the number of "unspent" doses remaining in the device 100, so that the user is informed when to replace the plurality of doses 114 within the device 100. The detector 174 can also provide feedback on the functioning of the movement mechanism 130 by observing the movement of the substrate 110 or doses 114 or heater 120, so as to inform a user if the movement mechanism 130 (or any associated element, e.g. connecting element 132) malfunctions.

The controller 172 may be a microcontroller so as to reduce space requirements. The detector 174 may be a break beam sensor, brushed system, speed tracker or the like to provide information on e.g. the number of rotations of the substrate 110 and the locations of the substrate 110 which have been moved to the heating zone 140. This information may be relayed to a user or to a diagnostics element (not shown) to enable regular checks on the functioning of the device 100.

The motion monitoring system 170 may be connected to the movement mechanism 130 by a wired connection such as a simple electrical connection or any other connection include wireless such as Bluetooth etc.

Figure 4:
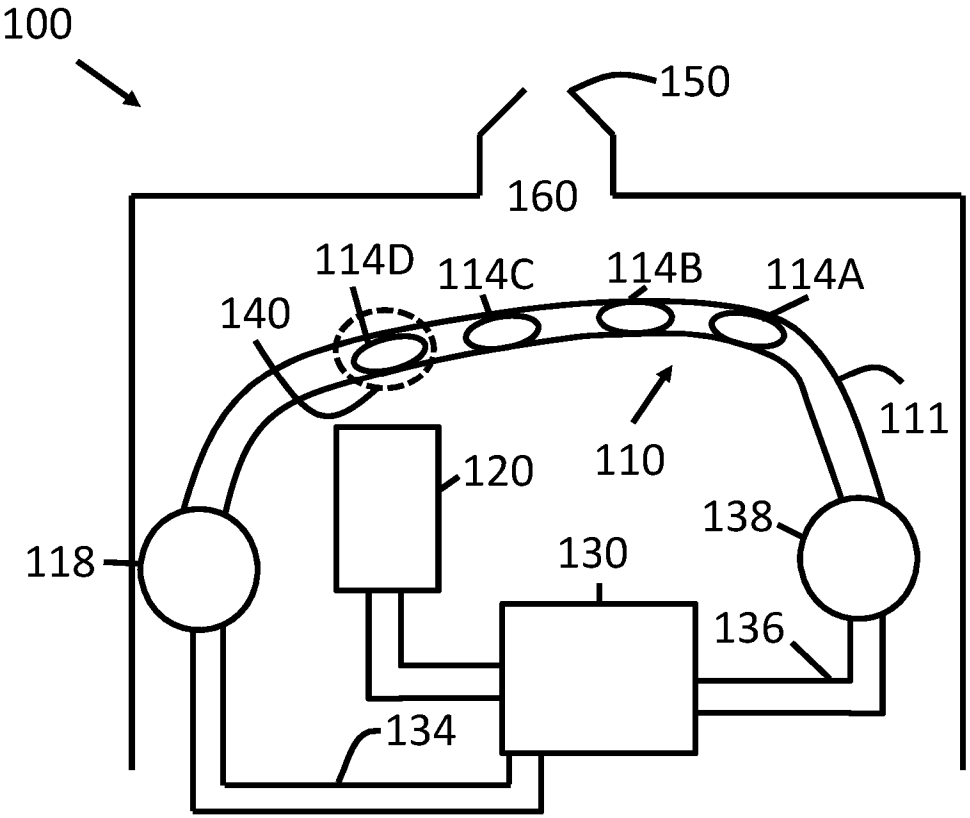
FIG. 4 is a schematic sectional view of a portion of an aerosol provision device according to an example.

FIG. 4 illustrates a schematic view of a portion of an aerosol provision device 100. The substrate 110 in the example shown in FIG. 4 is an elongate substrate 110 including an elongate carrier layer 111 with a plurality of doses 114 of aerosol generating medium located thereon. The doses 114 may be provided without a carrier layer 111 in some examples, by e.g. an elongate length of aerosol generating medium.

The movement mechanism 130 shown in FIG. 4 is arranged to move the doses of aerosol generating medium 114. The movement mechanism 130 may move the doses 114 in a substantially linear direction so as to, one by one, move the doses 114 into the heating zone 140 to generate an inhalable medium. The doses 114 are therefore linearly translatable past the heater 120, into the heating zone 140, such that respective doses 114 of aerosol generating medium are individually presented to the heater 120 to form an aerosol. The aerosol formed then flows along flow path 160 from the heating zone 140 to the aerosol outlet 150. The line along which the plurality of doses 114 are arranged to move is at an angle to the flow path 160 of the generated aerosol.

The substrate 110 as shown in the example of FIG. 4 is in the form of a strip with a plurality of doses 114 of aerosol generating medium along its length, wherein the plurality of doses 114 are individually distinct from one another. The strip may be in the form of a spool or wheel which is insertable into the device 100 by a user prior to use of the device 100. The strip may be inserted onto or into a rotating element 118 or the like which is moved by the movement mechanism 130 to enable movement of the strip. The rotating element 118 may be a turning wheel, a roller or a reel, onto which the strip in the form of a spool may be placed. After use, the substrate 110 may be removed from the device 100.

The device 100 may comprise a receiving mechanism 138 into which the plurality of doses 114 may be received having been heated in the heating zone 140. The receiving mechanism 138 is connected to the movement mechanism 130 by receiving mechanism connecting element 136. The receiving mechanism 138 may be a spool, wheel, roller, reel or the like, which may be wound by the movement mechanism 130 so as to move the doses 114 from a starting position near the rotating element 118, through the heating zone 140 and then into the receiving mechanism 138. The receiving mechanism 138 may alternatively be any other mechanism which can receive aerosol generating medium. The device 100 may comprise a monitoring system 170 as described above for monitoring the movement of the doses 114. The monitoring system 170 may be contained within the receiving mechanism 138, and may operate based on the detected amount of substrate 110 in the receiving mechanism 138.

The strip may be deemed depleted when the strip has moved entirely from the rotating element 118 and the original spool to the receiving mechanism 138 and onto the second spool. The user may then easily remove both spools 118, 138 from the device and replace with new spools 118, 138. This improves the cleanliness with which the aerosol generating material may be inserted and removed from the device 100.

Figure 5:
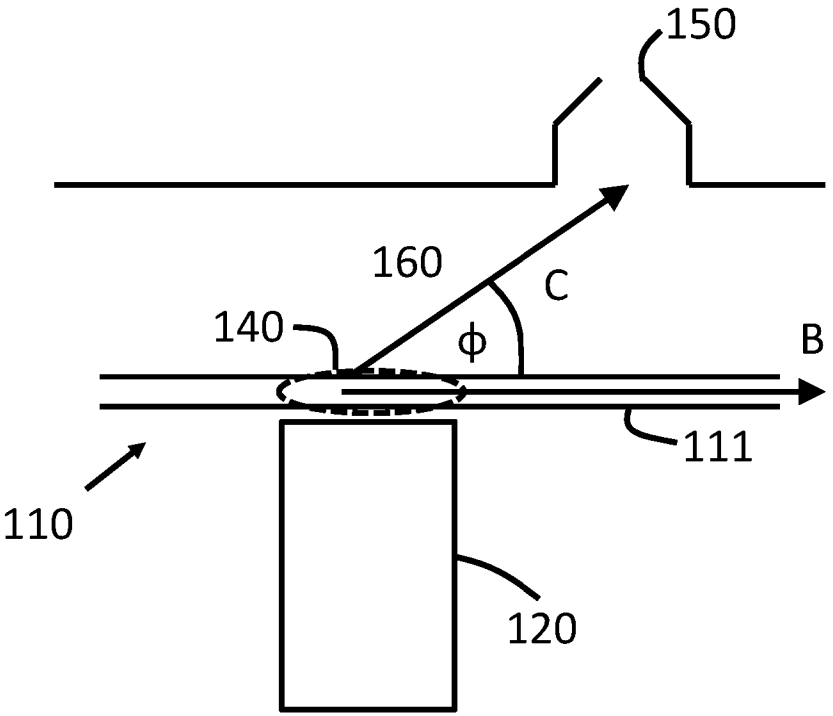
FIG. 5 is a schematic sectional view of a portion of an aerosol provision device according to an example; and, FIG. 6 is a schematic top-down view of a rounded substrate comprising portions of aerosol generating medium according to an example.

FIG. 5 illustrates a sectional view of a portion of an aerosol provision device 100. FIG. 5 shows an enlarged view of the portion of the device 100 including the substrate 110, the heater 120, the outlet 150 and the flow path 160. The direction of movement B of the substrate 110 is shown by arrow B. The general direction C of movement of the aerosol along the flow path 160 is shown by arrow C. The motion of the doses of aerosol generating medium is along an axis across the flow path. The difference between the direction of motion of the doses and the direction of the flow path of the aerosol is indicated by the angle φ. The angle φ is somewhat controlled by the relative locations of the heater 120 and the outlet 150. In the example shown, the heating zone 140 is arranged substantially between the aerosol outlet 150 and the heater 120. The outlet 150 may be arranged substantially in line with the heater 120 and the heating zone 140 such that the angle φ is substantially 90°. In other examples, the angle φ may be at least 5°, at least 10°, at least 15°, 20°, at least 25°, at least 30°, at least 35°, at least 40°, at least 45°, at least 50°, at least 55°, at least 60°, at least 65°, at least 70°, at least 75°, at least 80°, at least 85°.

The arrangement shown in FIG. 5 simplifies the flow path 160 taken by the aerosol, which in turn reduces the amount of time the aerosol is in the device 100. This arrangement therefore reduces the area on the inside of the device 100 on which the aerosol can condense, and the time during which it can condense. This therefore decreases the impact of any associated problems of intra-device aerosol condensation.

The substrate 110 and/or the plurality of doses 114 of aerosol generating medium may be substantially in the form of a number of shapes. The example shown in FIG. 4 has a substantially U-shape. The example shown in FIG. 5, though only a portion of a whole is shown, is substantially a flattened elongate bar. In other examples, the substrate 110 and/or the plurality of doses of aerosol generating medium 114 may be in the form of a ring. The substrate 110 may take these shapes when installed in the device 100 and be the same or a different shape when not in the device 100. The substrate 110 may have an alignment mechanism or a keying mechanism to enable the substrate 110 to be aligned with the movement mechanism 130 and to then connect to the movement mechanism 130.

In all the examples described so far, an aerosol generating medium 114 is in some way moved past a heater 120. This movement is provided by a movement mechanism 130. The movement mechanism 130 may comprise an indexing system (not shown) arranged to enable indexed motion of the doses 114 of aerosol generating medium. The indexing system moves a specific dose 114 in a stepwise manner into the heating zone 140 prior to generating an aerosol from that specific dose 114 and then out of the heating zone 140 after having generated an aerosol. The indexing system may enable greater precision of movement of one dose into the heating zone 140, that dose then being replaced by another dose. The indexing system can be provided by sprocketing and/or a keying mechanism arranged on, or forming part of, the substrate 110. In alternative examples, a Geneva wheel and cam combination can be used to provide an indexed motion of the doses 114 of aerosol generating medium.

The indexing system may be arranged to move adjacent doses 114 of aerosol generating medium into the heating zone 140 in turn. An advantage of this arrangement is that the indexing system is simple to construct and operate. Referring back to FIG. 4, specific dose 114B is arranged between specific dose 114A and specific dose 114C. During the heating of dose 114A, some heat energy may be transferred to dose 114B. In an arrangement wherein adjacent doses are heated in turn, energy can be saved in heating a second dose 114B due to the heat energy transferred by virtue of proximity to the second dose 114B during heating of a first dose 114A. This can in turn, reduce the total load on the heater 120 and therefore increase the lifetime of the device 100.

Alternatively, the indexing system may be arranged to move only non-adjacent doses 114 of aerosol generating medium into the heating zone 140 in turn. This enables a high density of doses 114 to be arranged on the carrier layer 111 without the danger of burning any particular dose 114B due to overly high levels of indirect heat (heat indirectly transferred to the dose during heating of a preceding dose 114A) followed by direct heat (heat provided to the dose during the heating of that same dose 114B). This arrangement removes any need for a sophisticated heating control system which provides variations in time or heating power for specific doses so as to prevent burning.

The indexing system may be observed by the monitoring system 170, using techniques as described above. This enables checks on the functionality of the indexing system to ensure the system is working as expected. In any of the above-described arrangements, the monitoring system 170 may be used to assist in preventing the overheating of any specific dose 114.

The movement mechanism 130 and monitoring system 170 can operate in combination with the heater 120 to ensure that indexed movements of the doses 114 and the heating periods for any specific dose 114 are coordinated to prevent burning of a dose 114. The movement mechanism 130 may be arranged to present one dose 114A of aerosol generating medium to the heater 120 for a period of time and present another dose 114B of aerosol generating medium to the heater 120 for a different period of time. This may be so as to provide different heating levels to different doses. This may be advantageous in avoiding burning in the event of linear indexing as mentioned above. This may also be advantageous when one dose 114A of aerosol generating medium is of a different structure or substance to another dose 114B, such that different heating periods are required to generate an aerosol.

The movement mechanism 130 and monitoring system 170 can operate in combination with the heater 120 to ensure that indexed movements of the doses 114 and the heater power levels for any specific dose 114 are coordinated. This may be so as to provide different heating levels to different doses. This may be advantageous in avoiding burning in the event of linear indexing, or high density dose provision. For example, the heater power level could be high for a first dose 114A and then less high for a second dose 114B. This is advantageous as the second dose 114B will have received some level of indirect heat during the heating of the first dose, such that a second dose 114B requires less direct heating (achieved by reducing the power level of the heater) to provide an aerosol. This may also be advantageous when one dose 114A of aerosol generating medium is of a different structure or substance to another dose 114B, such that different heater power levels are required to generate an aerosol.

Doses 114 of aerosol generating medium may comprise at least one of tobacco and glycol and may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder. The doses 114 may be separated, adjacent or overlapping.

The aerosol generating medium described herein comprises an "amorphous solid", which may alternatively be referred to as a "monolithic solid" (i.e. non-fibrous), or as a "dried gel". The amorphous solid is a solid material that may retain some fluid, such as liquid, within it. In some cases, the aerosol-forming layer comprises from about 50 wt %, 60 wt % or 70 wt % of amorphous solid, to about 90 wt %, 95 wt % or 100 wt % of amorphous solid. In some cases, the aerosol-forming layer consists of amorphous solid.

In some cases, the amorphous solid may comprise 1-50 wt % of a gelling agent wherein these weights are calculated on a dry weight basis.

Suitably, the amorphous solid may comprise from about 1 wt %, 5 wt %, 10 wt %, 15 wt %, 20 wt % or 25 wt % to about 50 wt %, 45 wt %, 40 wt %, 35 wt %, 30 wt % or 27 wt % of a gelling agent (all calculated on a dry weight basis). For example, the amorphous solid may comprise 5-40 wt %, 10-30 wt % or 15-27 wt % of a gelling agent.

In some embodiments, the gelling agent comprises a hydrocolloid. In some embodiments, the gelling agent comprises one or more compounds selected from the group comprising alginates, pectins, starches (and derivatives), celluloses (and derivatives), gums, silica or silicones compounds, clays, polyvinyl alcohol and combinations thereof. For example, in some embodiments, the gelling agent comprises one or more of alginates, pectins, hydroxyethyl cellulose, hydroxypropyl cellulose, carboxymethylcellulose, pullulan, xanthan gum guar gum, carrageenan, agarose, acacia gum, fumed silica, PDMS, sodium silicate, kaolin and polyvinyl alcohol. In some cases, the gelling agent comprises alginate and/or pectin, and may be combined with a setting agent (such as a calcium source) during formation of the amorphous solid. In some cases, the amorphous solid may comprise a calcium-crosslinked alginate and/or a calcium-crosslinked pectin.

Suitably, the amorphous solid may comprise from about 5 wt %, 10 wt %, 15 wt %, or 20 wt % to about 80 wt %, 70 wt %, 60 wt %, 55 wt %, 50 wt %, 45 wt % 40 wt %, or 35 wt % of an aerosol generating agent (all calculated on a dry weight basis). The aerosol generating agent may act as a plasticizer. For example, the amorphous solid may comprise 10-60 wt %, 15-50 wt % or 20-40 wt % of an aerosol generating agent. In some cases, the aerosol generating agent comprises one or more compound selected from erythritol, propylene glycol, glycerol, triacetin, sorbitol and xylitol. In some cases, the aerosol generating agent comprises, consists essentially of or consists of glycerol. If the content of the plasticizer is too high, the amorphous solid may absorb water resulting in a material that does not create an appropriate consumption experience in use. If the plasticizer content is too low, the amorphous solid may be brittle and easily broken. The plasticizer content specified herein provides an amorphous solid flexibility which allows the amorphous solid sheet to be wound onto a bobbin, which is useful in manufacture of aerosol generating articles.

In some cases, the amorphous solid may comprise a flavor. Suitably, the amorphous solid may comprise up to about 60 wt %, 50 wt %, 40 wt %, 30 wt %, 20 wt %, 10 wt % or 5 wt % of a flavor. In some cases, the amorphous solid may comprise at least about 0.5 wt %, 1 wt %, 2 wt %, 5 wt % 10 wt %, 20 wt % or 30 wt % of a flavor (all calculated on a dry weight basis). For example, the amorphous solid may comprise 10-60 wt %, 20-50 wt % or 30-40 wt % of a flavor. In some cases, the flavor (if present) comprises, consists essentially of or consists of menthol. In some cases, the amorphous solid does not comprise a flavor.

In some cases, the amorphous solid additionally comprises a tobacco material and/or nicotine. For example, the amorphous solid may additionally comprise powdered tobacco and/or nicotine and/or a tobacco extract. In some cases, the amorphous solid may comprise from about 1 wt %, 5 wt %, 10 wt %, 15 wt %, 20 wt % or 25 wt % to about 70 wt %, 60 wt %, 50 wt %, 45 wt % or 40 wt % (calculated on a dry weight basis) of a tobacco material and/or nicotine.

In some cases, the amorphous solid comprises a tobacco extract. In some cases, the amorphous solid may comprise 5-60 wt % (calculated on a dry weight basis) of tobacco extract. In some cases, the amorphous solid may comprise from about 5 wt %, 10 wt %, 15 wt %, 20 wt % or 25 wt % to about 55 wt %, 50 wt %, 45 wt % or 40 wt % (calculated on a dry weight basis) tobacco extract. For example, the amorphous solid may comprise 5-60 wt %, 10-55 wt % or 25-55 wt % of tobacco extract. The tobacco extract may contain nicotine at a concentration such that the amorphous solid comprises 1 wt % 1.5 wt %, 2 wt % or 2.5 wt % to about 6 wt %, 5 wt %, 4.5 wt % or 4 wt % (calculated on a dry weight basis) of nicotine. In some cases, there may be no nicotine in the amorphous solid other than that which results from the tobacco extract.

In some embodiments the amorphous solid comprises no tobacco material but does comprise nicotine. In some such cases, the amorphous solid may comprise from about 1 wt %, 2 wt %, 3 wt % or 4 wt % to about 20 wt %, 15 wt %, 10 wt % or 5 wt % (calculated on a dry weight basis) of nicotine. For example, the amorphous solid may comprise 1-20 wt % or 2-5 wt % of nicotine.

In some cases, the total content of tobacco material, nicotine and flavor may be at least about 1 wt %, 5 wt %, 10 wt %, 20 wt %, 25 wt % or 30 wt %. In some cases, the total content of tobacco material, nicotine and flavor may be less than about 70 wt %, 60 wt %, 50 wt % or 40 wt % (all calculated on a dry weight basis).

In some embodiments, the amorphous solid is a hydrogel and comprises less than about 20 wt % of water calculated on a wet weight basis. In some cases, the hydrogel may comprise less than about 15 wt %, 12 wt % or 10 wt % of water calculated on a wet weight basis (WWB). In some cases, the hydrogel may comprise at least about 2 wt % or at least about 5 wt % of water (WWB).

The amorphous solid may be made from a gel, and this gel may additionally comprise a solvent, included at 0.1-50 wt %. However, the inclusion of a solvent in which the flavor is soluble may reduce the gel stability and the flavor may crystallise out of the gel. As such, in some cases, the gel does not include a solvent in which the flavor is soluble.

The amorphous solid comprises less than 20 wt %, suitably less than 10 wt % or less than 5 wt % of a filler. The filler may comprise one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. The filler may comprise one or more organic filler materials such as wood pulp, cellulose and cellulose derivatives. In some cases, the amorphous solid comprises less than 1 wt % of a filler, and in some cases, comprises no filler. In particular, in some cases, the amorphous solid comprises no calcium carbonate such as chalk.

In some cases, the amorphous solid may consist essentially of, or consist of a gelling agent, an aerosol generating agent, a tobacco material and/or a nicotine source, water, and optionally a flavor.

It should be appreciated that the aerosol generating material may be any other suitable aerosol generating material as deemed appropriate by the skilled person.

Figure 6:
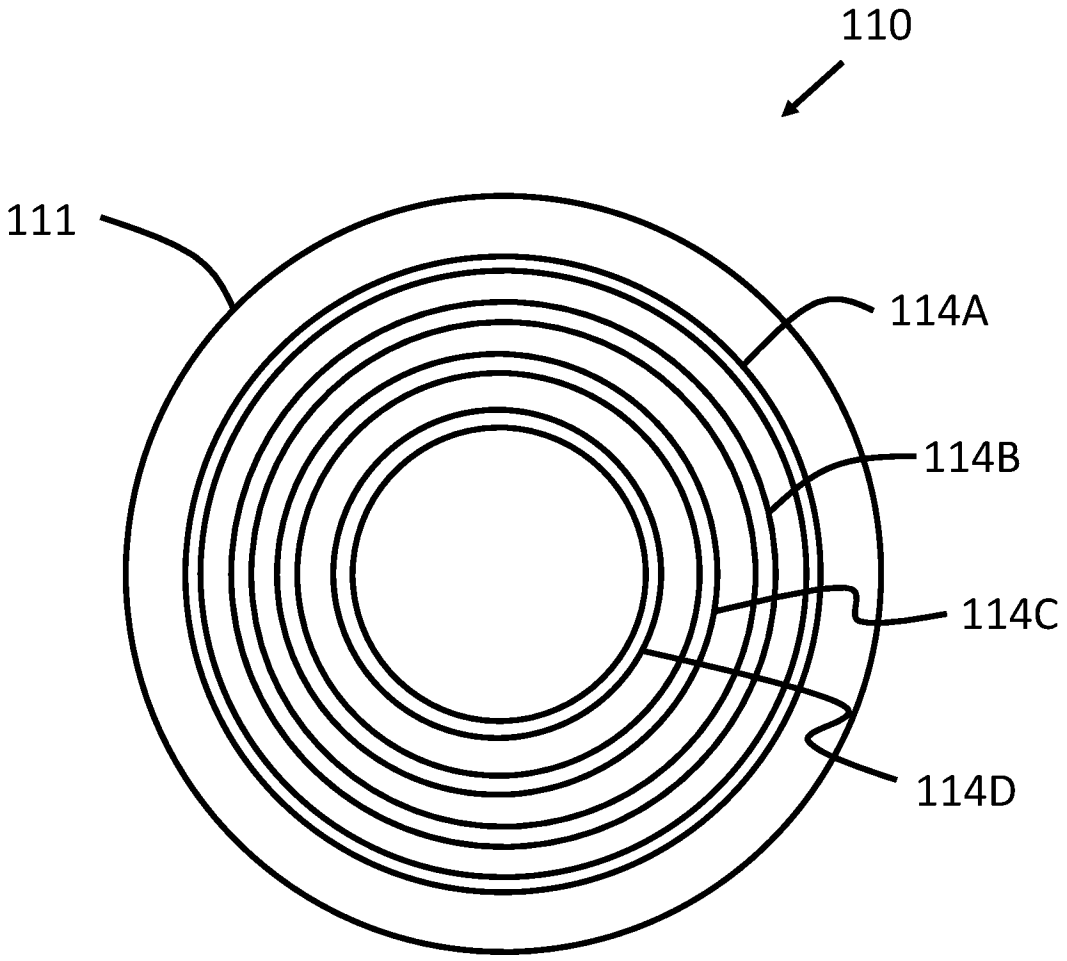

Referring to FIG. 6, an example of an arrangement of doses 114A, 114B, 114C, 114D on a rounded substrate 110 is shown. The doses 114 are arranged in concentric rings which may be heated in order via rotational indexing of the substrate, followed by lateral indexing of the heater 120 to be arranged to heat the next ring in the sequence of concentric rings. This indexing sequence can repeat until each dose 114 is heated to produce aerosol. The indexing provided to the substrate 110 may be even or uneven in distance and/or time as discussed earlier. In an example, the final dose 114 to be heated is arranged towards the center of the substrate 110. This dose 114D may be, for example, a dose 114D comprising menthol to provide a refreshing conclusion to a smoking session. A user may be able to personalize the smoking session through use of varying arrangements of aerosol generating medium.

It is clear that there is no restriction that the doses 114 should be in an arrangement with rotational symmetry particularly with lateral movement of the heater 120.

In the examples above wherein the device has doses 114 arranged on a carrier layer 111, the substrate 110 may have a base which is substantially impermeable to aerosol. For example, the base layer may be disposed on the second surface of the carrier layer (ot the base layer may be the carrier layer in other implementations). This arrangement encourages the aerosol generated from heating of the aerosol generating medium doses 114 to flow away from the heater 120 and along the flow path 160 towards the outlet 150. This reduces the likelihood of condensation of aerosol within the device 100 and, as mentioned above, therefore increases both the cleanliness and lifetime of the device 100. The base may be formed of at least one of materials such as paper, cardboard, wood pulp, plastic, ceramic, tobacco or a nicotine containing substance, etc.

The substrate 110 may be impermeable to aerosol or may be porous such that the aerosol generating medium may be located in the pores of the substrate 110. In an example, the substrate 110 may have permeable and impermeable portions. Permeable portions may be located in portions wherein it is desirable to have aerosol pass through the substrate, such as to allow flow through the substrate 110 and towards the outlet of the device 100. Impermeable portions may be located in portions wherein it is desirable to prevent aerosol flowing towards the source of energy for heating 120.

Thus there has been described an aerosol provision device comprising: a plurality of doses of aerosol generating medium; and a heater, wherein the heater is configured to heat the doses of aerosol generating medium to form an aerosol; a movement mechanism arranged to move doses of aerosol generating medium; a heating zone into which doses of aerosol generating medium are moved by the movement mechanism to form an aerosol; an aerosol outlet through which an aerosol can flow to be inhaled by a user; and a flow path arranged between the heating zone and the aerosol outlet such that aerosol formed from heated doses of aerosol generating medium flows along the flow path, wherein the doses of aerosol generating medium are linearly translatable past the heater, into the heating zone, such that respective doses of aerosol generating medium are individually presented to the heater to form an aerosol; and wherein the plurality of doses of aerosol generating medium are arranged to move along a line that is at an angle to the flow path of generated aerosol.

The aerosol provision system may be used in a tobacco industry product, for example a non-combustible aerosol provision system.

In one embodiment, the tobacco industry product comprises one or more components of a non-combustible aerosol provision system, such as a heater and an aerosolizable substrate (e.g., a substrate comprising aerosol generating material). In one embodiment, the aerosol provision system is an electronic cigarette also known as a vaping device.

In one embodiment the electronic cigarette comprises a heater, a power supply capable of supplying power to the heater, an aerosolizable substrate such as a liquid or gel, a housing and optionally a mouthpiece.

In one embodiment the aerosolizable substrate is contained in or on a substrate container. In one embodiment the substrate container is combined with or comprises the heater.

In one embodiment, the tobacco industry product is a heating product which releases one or more compounds by heating, but not burning, a substrate material. The substrate material is an aerosolizable material which may be for example tobacco or other non-tobacco products, which may or may not contain nicotine. In one embodiment, the heating device product is a tobacco heating product.

In one embodiment, the heating product is an electronic device.

In one embodiment, the tobacco heating product comprises a heater, a power supply capable of supplying power to the heater, an aerosolizable substrate such as a solid or gel material.

In one embodiment the heating product is a non-electronic article.

In one embodiment the heating product comprises an aerosolizable substrate such as a solid or gel material, and a heat source which is capable of supplying heat energy to the aerosolizable substrate without any electronic means, such as by burning a combustion material, such as charcoal.

In one embodiment the heating product also comprises a filter capable of filtering the aerosol generated by heating the aerosolizable substrate.

In some embodiments the aerosolizable substrate material may comprise aerosol vapor or aerosol generating agent or a humectant, such as glycerol, propylene glycol, triacetin or diethylene glycol.

In one embodiment, the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment, the hybrid system comprises a liquid or gel substrate and tobacco.

In order to address various issues and advance the art, the entirety of this disclosure shows by way of illustration various embodiments that may be practiced and provide for a superior electronic aerosol provision system. The advantages and features of the disclosure are of a representative sample of embodiments only, and are not exhaustive and/or exclusive. They are presented only to assist in understanding and teaching the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes inventions not presently claimed, but which may be claimed in future.

The invention claimed is:

1. An aerosol provision system comprising:

an aerosol generating medium;

a source of energy for heating, wherein the source of energy for heating is configured to cause heating of the aerosol generating medium in a heating zone;

a movement mechanism arranged to move the aerosol generating medium;

an aerosol outlet through which an aerosol can flow to be inhaled by a user; and a flow path arranged between the heating zone and the aerosol outlet such that aerosol formed from heated aerosol generating medium flows along the flow path, wherein the aerosol generating medium is translatable past the source of energy for heating, into the heating zone, such that respective portions of aerosol generating medium are individually presented to the source of energy for heating to form an aerosol;

wherein the aerosol generating medium is arranged to move along a line that is at an angle to the flow path of generated aerosol; and wherein the movement mechanism is arranged to present a first portion of aerosol generating medium to the source of energy for heating for a first period of time and present a second portion of aerosol generating medium to the source of energy for heating for a second period of time, wherein the first period of time is different to the second period of time.

2. The aerosol provision system of claim 1, wherein the motion of the aerosol generating medium enabled by the movement mechanism is along an axis that is across the flow path.

3. The aerosol provision system of claim 1, wherein the movement mechanism is arranged to enable indexed motion with at least one of fixed or varied distances per index or fixed or varied time intervals per index.

4. The aerosol provision system of claim 1, wherein the aerosol generating medium, when connected to the movement mechanism, takes any of the shapes of:

a ring;

a flattened elongate bar; and a U-shape.

5. The aerosol provision system of claim 1, wherein the movement mechanism is configured to move respective portions into the heating zone such that adjacent portions of aerosol generating medium are moved into the heating zone in turn.

6. The aerosol provision system of claim 1, wherein a first power level of the source of energy for heating for heating one portion of aerosol generating medium when presented to the source of energy for heating is different to a second power level of the source of energy for heating for heating a different portion of aerosol generating medium when presented to the source of energy for heating.

7. The aerosol provision system of claim 1, wherein the aerosol generating medium is translatable past the source of energy for heating, into the heating zone, such that portions of aerosol generating medium are individually presented to the source of energy for heating to form an aerosol.

8. The aerosol provision system of claim 1, wherein the aerosol generating medium is planar and has a normal axis which is substantially parallel to the axis of the aerosol outlet.

9. A method of generating an aerosol in an aerosol provision system, comprising:

providing an aerosol generating medium;

providing a source of energy for heating;

providing a movement mechanism;

providing an aerosol outlet through which an aerosol can flow to be inhaled by a user;

individually moving portions of the aerosol generating medium by the movement mechanism past the source of energy for heating into a heating zone by translation, heating a first portion of the portions of aerosol generating medium presented to the source of energy for heating in the heating zone to form an aerosol;

wherein the aerosol generating medium is arranged along a line that is at an angle to a flow path of generated aerosol, the flow path arranged between the heating zone and the aerosol outlet; and wherein the method comprises the movement mechanism presenting a first portion of aerosol generating medium to the source of energy for heating for a first period of time and presenting a second portion of aerosol generating medium to the source of energy for heating for a second period of time, wherein the first period of time is different to the second period of time.

10. The method of claim 9, wherein individually moving the portions of the aerosol generating medium by the movement mechanism past the source of energy for heating into a heating zone involves presenting the portions of the aerosol generating medium to the source of energy for heating not in sequential order.

11. The method of claim 9, further comprising heating one portion of the portions of the aerosol generating medium when presented to the source of energy for heating in the heating zone at a first power level that is different to a second power level for heating a different portion of the portions of the aerosol generating medium when presented to the source of energy for heating in the heating zone.

12. The method of claim 9, wherein moving the portions of the aerosol generating medium by the movement mechanism past the source of energy for heating into the heating zone comprises moving the portions by indexed motion past the source of energy for heating into the heating zone.

13. The method of claim 12, wherein moving the portions by indexed motion past the source of energy for heating into the heating zone comprises linearly indexing the portions of the aerosol generating medium past the source of energy for heating into the heating zone.

14. The method of claim 9, wherein individually moving the portions of the aerosol generating medium by the movement mechanism past the source of energy for heating into the heating zone by translation comprises individually moving the portions of the aerosol generating medium by the movement mechanism past the source of energy for heating into the heating zone by linear translation.

15. An aerosol provision device configured to receive aerosol generating medium, comprising:

a source of energy for heating, wherein the source of energy for heating is configured to cause, in use, heating of the aerosol generating medium in a heating zone;

a movement mechanism arranged to, in use, move the aerosol generating medium;

an aerosol outlet through which, in use, an aerosol can flow to be inhaled by a user; and a flow path arranged between the heating zone and the aerosol outlet such that, in use, aerosol formed from heated aerosol generating medium flows along the flow path, wherein the aerosol generating medium is translatable past the source of energy for heating, into the heating zone, such that respective portions of the aerosol generating medium are individually presented to the source of energy for heating to form an aerosol, wherein the movement mechanism is arranged, in use, to move the aerosol generating medium along a line that is at an angle to the flow path of generated aerosol; and wherein the movement mechanism is arranged to present a first portion of aerosol generating medium to the source of energy for heating for a first period of time and present a second portion of aerosol generating medium to the source of energy for heating for a second period of time, wherein the first period of time is different to the second period of time.

16. Aerosol provision means comprising:

aerosol generating means; and heating means, wherein the heating means is configured to heat the aerosol generating means to form an aerosol;

movement provision means arranged to move the aerosol generating means;

a heating zone into which the aerosol generating means are moved by the movement provision means to form an aerosol an aerosol outlet means through which an aerosol can flow to be inhaled by a user; and a flow path arranged between the heating zone and the aerosol outlet means such that aerosol formed from heated aerosol generating means flows along the flow path;

wherein the aerosol generating means are linearly translatable past the heating means, into the heating zone, such that respective portions of aerosol generating means are individually presented to the heating means to form an aerosol;

wherein the aerosol generating means are arranged to move along a line that is at an angle to the flow path of generated aerosol; and wherein the movement mechanism is arranged to present a first portion of aerosol generating medium to the source of energy for heating for a first period of time and present a second portion of aerosol generating medium to the source of energy for heating for a second period of time, wherein the first period of time is different to the second period of time.

17. The aerosol provision system of claim 1, wherein the heating zone is arranged substantially between the aerosol outlet and the source of energy for heating.

18. The aerosol provision system according to claim 1, wherein the movement mechanism comprises an indexing system arranged to enable indexed motion of the aerosol generating medium.

* * * * *